United States Patent [19]

Reynertson

[11] 4,442,052

[45] Apr. 10, 1984

[54] FORM FOR REFRACTORY-FACED TUBE SHEETS

[75] Inventor: Philip S. Reynertson, Ballwin, Mo.

[73] Assignee: Monsanto Company, St. Louis, Mo.

[21] Appl. No.: 365,209

[22] Filed: Apr. 5, 1982

[51] Int. Cl.[3] ..... F27D 1/16

[52] U.S. Cl. ..... 264/30; 249/175; 249/177

[58] Field of Search ..... 264/30; 249/175, 177

[56] References Cited

U.S. PATENT DOCUMENTS 1,765,156 6/1930 Henly ..... 249/177

*Primary Examiner*—Thomas P. Pavelko

*Attorney, Agent, or Firm*—L. L. Limpus

[57] ABSTRACT

A form is provided for use in vessels having a shell and tube configuration with refractory material protecting the tube sheet to provide a flared entrance or exit for the tubes. The form has a shank end, formed as a cylinder for insertion within the tubes, and a flared end which expands at an angle of from about 15° to about 20°.

5 Claims, 4 Drawing Figures

FORM FOR REFRACTORY-FACED TUBE SHEETS

BACKGROUND OF THE INVENTION

This invention relates to an improvement in the design of refractory-faced tube sheets in boilers of the shell and tube configuration. More particularly, it relates to an improvement in the design of the inlet and outlet of the tube passing through the tube sheets of such boilers. More particularly, it relates to a design for a removable or consumable form for producing a new inlet design for the tubes to reduce the energy loss by the fluid passing through the tubes.

DESCRIPTION OF THE PRIOR ART

Shell and tube type boilers have been in use for many years. Where extremely high temperatures are present it has been common to protect the tube sheet with a layer of refractory material. The refractory material is poured in place after installation of the tubes and tube sheets in the boiler. It is common to extend the straight tube inlet to the face of the refractory material to prevent the refractory material from entering the tube and causing pluggage through the use of a metal or ceramic ferrule which also provides a shaped inlet for the tube. The slightly flared metal or ceramic ferrules now used include a shank which is inserted within the boiler or heat exchanger tube. This shank restricts the flow through the initial portion of the tube and because of the restriction causes an increase in the flow velocity through the entrance of the tube. This acceleration of the fluid flow results in higher turbulence, higher energy losses, and greater erosion rates at the tube inlet just inside the tube sheet.

SUMMARY OF THE INVENTION

It is an object of this invention to provide a method of reducing the energy loss and the erosion at the inlet of the tubes in a shell and tube type boiler.

It is a further object of this invention to provide a removable or consumable form for use in the production of refractory-faced tube sheets in shell and tube type boilers.

These and other objects are obtained by a method of construction in which a removable or consumable form is inserted in the end of each tube of the boiler prior to the pouring, ramming, or gunning of the refractory material. The form produces a flared passageway through the refractory material as an inlet to the tubes to reduce the turbulence and pressure drop at the tube inlet. After the installation and initial set of the refractory material, the forms may be removed to provide the flared passageway. If the forms are constructed of a consumable material such as a plastic, they may be left in place and consumed by the introduction of the heated process material to the boiler.

The apparatus of this invention is a form for producing a flared inlet to the tube of a shell and tube boiler. The form may be constructed of a material which must be removed from the tube prior to use of the boiler or of a light material that may be consumed with the introduction of hot process fluids to the vessel. In a first configuration, the form is constructed having a straight shank for insertion within the tubes. From the shank, the form flares or expands conically outwardly at an included angle of from about 15° to about 20°. The flared portion of the form will be of a length equal to or slightly longer than the contemplated thickness of the refractory material which will be poured into place on the face of the tube sheet.

Heretofore, discussions have centered on modifications to the inlet of the tube of the shell and tube type boiler and heat exchanger. It must be recognized that this invention is equally applicable to the outlet of the tube and further energy may be saved by providing a similar modification at the outlet of the tube.

In an alternative embodiment of the invention for use at the tube inlet of a shell and tube type heat exchanger, the form again has a straight shank which is to be inserted within the heat exchanger tube. The portion of the form which is to be external of the tube is designed with an outward radius of curvature at the tube inlet. This embodiment of the invention provides a greater reduction in the loss of energy than does the preferred embodiment; however, this shape may not be used with refractory material.

DESCRIPTION OF THE PREFERRED EMBODIMENTS

Figure 1:
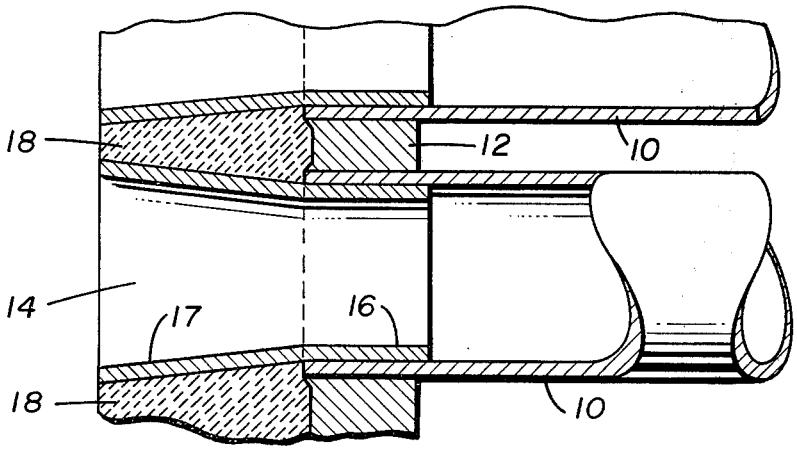
FIG. 1 is a cross sectional view of a boiler tube and tube sheet showing the ceramic or metal ferrule of the prior art.

Turning now to FIG. 1 there is shown a cross sectional view of a boiler tube and tube sheet showing the ceramic or metal ferrule of the prior art. In a boiler of the shell and tube configuration, a plurality of tubes 10 is installed. Each end of the tube 10 is held in place within the boiler by a tube sheet 12. In FIG. 1 only one end of the tube 10 and a portion of the tube sheet 12 are shown. A ceramic or metal ferrule 14 is shown with shank 16 inserted within the end of tube 10 and straight or flared end 17, here shown as flared, extending outwardly from the tube 10. Refractory material 18 is shown in place surrounding the flared end 17 of ferrule 14 and adjacent to the tube sheet 12. As may be easily noticed from FIG. 1 the shank end 16 of ferrule 14 creates a narrowing within the end of tube 10. Fluid flow through the ferrule 14 into tube 10 causes a vena contracta within the shank 16 and the sudden expansion, and resulting turbulence after the vena contracta inside the tube 10 cause a greater erosion on that portion of the tube 10 close to the ferrule 14. In addition, this narrowing of the tube diameter creates a higher pressure drop across the entrance to the tube 10.

Figure 2:
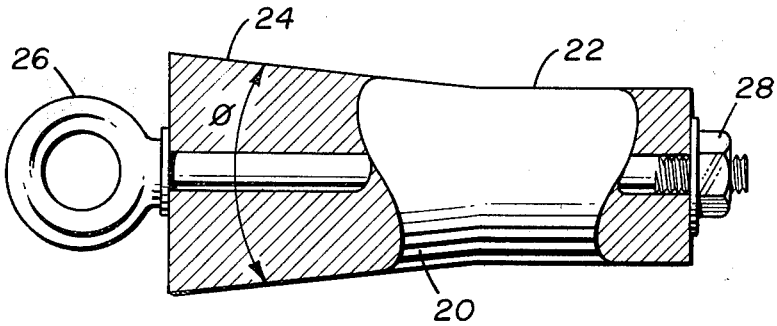
FIG. 2 is a view of the form which is the preferred embodiment of this invention.

Turning now to FIG. 2, an example of the form of this invention is shown. Form 20 has a shank 22 which is to be inserted within a tube in a shell and tube boiler in a manner similar to that of the ferrule shown in FIG. 1. The diameter of shank 22 is chosen to be less than, but approximately equal to, the internal diameter of the tube. The length of shank 22 is chosen to enable form 20 to be securely seated in the end of the tube while avoiding the use of excessive material in fabricating the forms 20. Typically, shank 22 will be at least about 5.08 cm in length. Form 20 also has a flared end 24 which extends conically outwardly from the shank 22. The flared end 24 of form 20 flares or expands conically outwardly with an included angle of flare $\phi$ of from about 15° to about 20°. The length of the flared end 24 must be sized to be equal to or greater than the thickness or depth of the refractory material which will be installed about the form. Also shown in FIG. 2 is bolt 26 which extends through the form 20 and is held in place by nut 28. Bolt 26 is shown here for the convenience of the user to enable easy installation of the form 10 and, after the addition of the refractory material about form 20, bolt 26 may be used to remove form 20 from the end of the tubes. It is noted that bolt 26 need not have the configuration shown here and, in fact, need not be present at all. If form 20 is fabricated from a material that is consumable by the hot process material which enters the vessel, the bolt is unnecessary. In addition, even though form 20 is shown as a solid object, form 20 may be hollow and a different bolt arrangement would be necessary. Form 20 as shown here may be made of numerous materials and wood, plastic or metal will work equally well. A preferred material of construction is wood such as oak or Douglas fir which has been sanded to a smooth finish and varnished well, for example with a polyurethane varnish. When produced from wood form 20 becomes sufficiently sturdy to be used more than one time and, through the use of wood, damage to the end of the boiler tubes may be minimized.

Figure 3:
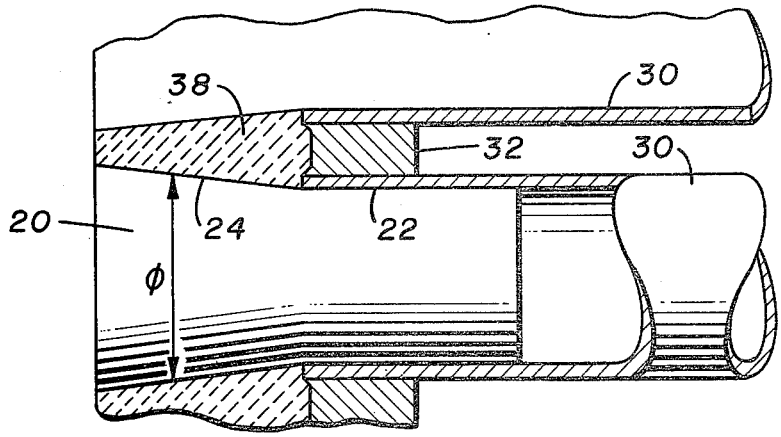
FIG. 3 is a cross sectional view of a boiler tube and tube sheet with the form of the present invention shown in use.

Turning now to FIG. 3, the form 20 shown in FIG. 2 is now shown installed in the tube 30 of the boiler. Form 20 is shown with the shank end 22 installed within tube 30 and flared end 24 extending from tube 20. Tube 30 is shown being retained within tube sheet 32 which is used to hold all of the tubes within the vessel in their respective places. Refractory material 38, which is permanently held in place with refractory anchors, is shown surrounding the flared end 24 of form 20 and abutting the face of tube sheet 32. A set of forms 20 may be reused. When the form 20 is removed from the tube 30, the refractory material 38 will provide a conical smoothly flared inlet to the tube 30 which will narrow to have a diameter equal to the internal diameter of the tube 30. The refractory material 38 is used to protect the tube sheet 32 and the ends of tube 30 from the effects of heat and erosion caused by the process material which will enter the boiler and its flared shape provides a reduction in the pressure drop at the entrance to, or exit from, the tube 30.

The form 20 for any specific boiler installation will be of a size to fit the tubes within that boiler. The length of the shank end 22 of form 20 will be chosen to enable form 20 to be securely seated in the end of tube 30 while avoiding the use of excessive material for the fabrication of the forms 20. The flared end of form 20 must be sized to match or slightly exceed the desired depth of the refractory material 38. This depth will be chosen to provide adequate protection for the tube sheet 32 from the process fluid. For a typical boiler tube size of 5.08 cm which has an internal diameter of 3.96 cm, the form 20 of this example has a shank end 22 having the dimensions of approximately 5.08 cm in length and 3.81 cm in diameter. The flared end 24 of this form 20 has a length of approximately 7.62 cm and a diameter which smoothly increases or flares from about 3.81 cm at the shank 22 to about 6.35 cm. The form 20 of this example has a total length of approximately 12.7 cm and the included angle $\phi$ is approximately 15°.

The preferred embodiment of this invention has been discussed hereinabove in terms of its use within a shell and tube type boiler. However, it must be recognized that its use is not limited to use only within boilers. The forms of this invention may be used in any vessel having the shell and tube configuration in which the shell encloses a plurality of tubes which are retained by tube sheets. Further examples of such a vessel include shell and tube heat exchangers and condensers.

The embodiment of this invention shown in FIGS. 2 and 3 has been discussed hereinabove primarily in terms of its use at the inlet of the tube of a shell and tube type boiler or heat exchanger. It must be recognized that its use is not limited to the inlet of the tubes; it may also be used at the exit of the tubes without any change from the configuration discussed above. FIG. 3 serves a dual purpose. The figure may be considered as showing this invention in use at the inlet of a tube of a boiler or heat exchanger. In that instance form 20 is shown in use with tube 30 to provide a flared inlet to the tube. FIG. 3 serves the second purpose of showing the form of this invention in use at the exit of a tube in a boiler or heat exchanger. In this latter instance form 20 is shown installed at the exit of tube 30 and the refractory material 38 surrounding form 20 and abutting tube sheet 32 provides a conically flared exit from the tube 30. It is noted that the use of the form 20 of this invention at both the entrance and exit of the tubes in shell and tube type vessels has provided a less expensive installation while increasing the protection of the tube sheet 32 and tubes 30 from high temperatures and erosion from the process fluid and has reduced the pressure drop created at the entrance and exit of the tubes 30.

Figure 4:
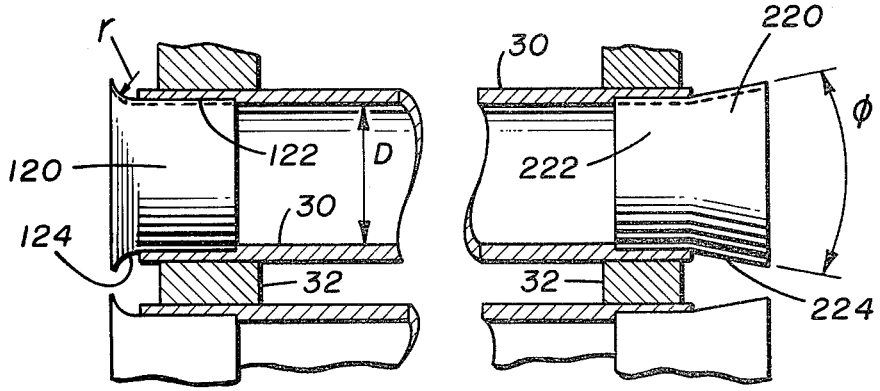
FIG. 4 is a cross sectional view of a heat exchanger tube and tube sheet showing an alternative embodiment of this invention and showing this invention being used at the outlet of the tubes.

Turning now to FIG. 4, a second embodiment of the form of this invention is shown. Form 120 is shown in place at the entrance to tube 30 which is retained in place by tube sheet 32. Form 120, as in the preferred embodiment, includes a shank 122 which is inserted within tube 30 and a flared end 124 which extends outwardly from the tube 30. Form 120 differs from the first embodiment which is shown in FIGS. 2 and 3 in two respects, in its construction and in its use. Form 20, discussed above, is formed as a solid or hollow body having a shank 22 and a flared end 24 which expands outwardly at an included angle of from about 15° to about 20°. This second embodiment is formed as a hollow, thin metal cylinder which has one end flared as will be discussed below. Form 120 is constructed of a relatively thin metal such as stainless steel which is capable of withstanding the temperature, pressure, and erosion problems which occur within heat exchangers or condensers of the shell and tube type. Form 120 has a shank end 122 which is shown in FIG. 4 as being inserted within the end of tube 30. The flared end 124 of form 120 is shown extending from tube 30 and is flared outwardly at a radius r, for example at a radius r equal to 0.125 times the diameter D of the tube 30. Form 120 is designed to be installed within the end of tube 30 and to remain in that position during operation of the vessel. To retain form 120 within the end of tube 30 the thin metal cylinder of form 120 is rolled, bonded, or tack welded into the end of tube 30. During the installation the end of tube 30 is expanded slightly so that the diameter D of tube 30 will remain substantially the same through both the pipe and the form 120 after installation of the form. The points of the flared ends 124 are spaced so closely together that the refractory material cannot be properly installed. Therefore, the forms 120 are designed to remain in place during operation of the vessels to protect the tube sheet 32 and the tube 30 during the operation and to decrease the pressure lost at the inlet to tube 30. Unlike the ferrules 14 of the prior art shown in FIG. 1, the internal diameter of shank end 122 is substantially equal to the internal diameter D of tube 30 and the process flow problems created by the reduced internal diameter through the shank end 16 of ferrule 14 are avoided by the form 120.

In FIG. 4 at the outlet of the tube 30, a form 220, very similar to form 120, is shown. Form 220 differs from form 120 only in the shape of the flared end which extends outwardly from the tube 30. Form 220 has a shank end 222 which is inserted within the end of tube 30 and is retained in place by rolling, bonding, or tack welding the shank end 222 to the tube 30. As was discussed in regard to the form 120, the tube 30 is expanded slightly when shank end 222 of form 220 is inserted so that the internal diameter of the shank end is substantially equal to the internal diameter D of tube 30. The flared end 224 of form 220 expands or flares outwardly from the end of tube 30 at an included angle of from about 15° to about 20°. Form 220, like form 120, is constructed of a relatively thin metal, for example stainless steel, which is able to withstand the effects of the temperature and process fluid. Form 220 is designed to remain in place during operation of the vessel. The shape of the flared end 224 makes it possible for refractory material to be placed between adjacent forms and against the tube sheet 32. Since the form 220 is designed to remain in place, the refractory material is not essential; however, refractory material may be installed if desired.

The form of this invention is used to produce a flared inlet and/or outlet for the tubes in a shell and tube type boiler, heat exchanger or condenser to reduce the energy loss created when fluid enters and exits from the tubes. An example of the energy savings that may be achieved using this invention is shown below.

For the example shown below 38 cubic meters per second of a gas having a density at standard conditions of 1.328 Kg/M$^3$ (kilogram per cubic meter) flow through a boiler having 2223 tubes. Each tube has an outer diameter of 5.08 cm and a wall thickness of 0.304 cm. The refractory material on the face of the tube sheet has a thickness or depth of 7.62 cm and the flared entrance and exit to the tubes each have an included angle $\phi$ of 17°. The process conditions for this example are:

$T_1$=Inlet Temperature=861° C.

$T_2$=Outlet Temperature=557° C.

$P_1$=Inlet Pressure=989.2 mm Hg (millimeter of Mercury)

$P_2$=Outlet Pressure=973.3 mm Hg

Using the ideal gas relationships $$P_1V_1/T_1=P_2V_2/T_2 \quad (1)$$

$$P=\rho RT \quad (2)$$

and $$P_1/P_2=\rho_1T_1/\rho_2T_2$$

where P is pressure, V is volume and T is temperature, the following densities and velocities at the operating conditions were calculated:

$\rho_1$=Inlet Gas Density=0.676 Kg/M$^3$ (0.0422 pounds/Ft$^3$)

$\rho_2$=Outlet Gas Density=0.859 Kg/M$^3$ (0.0536 pounds/Ft$^3$)

$v_1$=Mean Inlet Gas Velocity=1374 M/Min. (4508 Ft/Min.)

$v_2$=Mean Outlet Gas Velocity=1083 M/Min. (3554 Ft/Min.)

From the *ASHRAE Handbook and Product Directory,* 1977 *Fundamentals* published by the American Society of Heating, Refrigerating and Air-Conditioning Engineers (1978) at page 31.8:

$$\Delta P_T=C_O\rho(V/1097)^2 \quad (4)$$

where $\Delta P_T$=total losses in a fitting in terms of the total pressure in inches of water $C_O$=Overall gas coefficient $\rho$=Gas density in pounds per cubic foot, and v=Mean air velocity in feet per minute.

$C_O$ is found in the *ASHRAE Handbook* at page 31.25. For an L/D ratio of $$L/D=7.62\text{ cm}/[5.08-2(0.304)]\text{ cm}=1.7$$

where

L=length of the conical converging inlet which is the depth of the refractory, and D=internal diameter of the tube and an included angle $\phi$ of 17°, $C_O$=0.15. Thus, substituting in equation (4) for the inlet to the tube:

$$\Delta P_T=(0.15)(0.0422)(4508/1097)^2$$

$$\Delta P_T=0.107\text{ inches of water}$$

$$\Delta P_T=0.20\text{ mm Hg}$$

In comparison an abrupt tube entrance, that is an entrance which does not have the flared inlet, has a coefficient $C_O$=1.0. Again, substituting in equation (4):

$$\Delta P_T=(1.0)(0.0422)(4508/1097)^2$$

$$\Delta P_T=0.71\text{ inches of water}$$

$$\Delta P_T=1.33\text{ mm Hg.}$$

The flared entrance to the tube in this example reduces the pressure loss at the tube entrance from 1.33 mm Hg to 0.20 mm Hg, an energy savings of 1.13 mm Hg.

A similar calculation may be made for the energy savings at the exit of the tube. Equation (4) is again used. $C_O$ is found in the *ASHRAE Handbook* at page 31.26. The internal diameter of the tube, the depth of the refractory material and the included angle $\phi$ are the same as those used for the entrance to the tube. For an L/D=1.7 and an included angle of 17°, $C_O$=0.4536. Substituting this value in equation (4) and using the density and mean velocity for the tube exit:

$$\Delta P_T=(0.4536)(0.0536)(3554.5/1097)^2$$

$$\Delta P_T=0.255\text{ inches of water}$$

$$\Delta P_T=0.48\text{ mm Hg}$$

An abruby exit has $C_O$=1.0. When this value is used in equation (4)

$$\Delta P_T=(1.0)(0.0536)(3554.5/1097)^2$$

$$\Delta P_T=0.563\text{ inches of water}$$

$$\Delta P_T=1.05\text{ mm Hg.}$$

The flared exit to the tube of this example reduces the pressure loss at the tube exit from 1.05 mm Hg to 0.48 mm Hg, an energy savings of 0.57 mm Hg. The results calculated above are shown in Table 1.

TABLE 1

| | Pressure Drop (mm Hg) | | |
|---|---|---|---|
| | Abrupt Tube End | Flared Tube End | Reduction of Pressure Drop |
| Tube Entrance | 1.33 | 0.20 | 1.13 |
| Tube Exit | 1.05 | 0.476 | 0.57 |
| Total Pressure Drop Reduction | | | 1.70 |

The movement of process gas through a process plant or through a boiler requires a pressure differential. The greater the pressure drop at each piece of equipment, such as the boiler or heat exchanger discussed with this invention, the greater the initial pressure must be at the plant entrance and the larger and more expensive must be the equipment to supply the pressure. Therefore, a reduction in the pressure drop at a single piece of equipment has a value, because it reduces the total pressure required at the plant entrance. A typical number for the value of the pressure drop reduction is in the range of approximately $8500 savings each year for each reduction of one (1) millimeter of mercury. Using this approximation the pressure drop reduction shown in the above example would have a value of Value=[$8500 per year/1 mm Hg]1.70 mm Hg Value=$14,450 per year for the single boiler or heat exchanger discussed above.

It has been shown that the form of this invention may be used to create a conically flared entrance or exit for the tubes of a vessel having a shell and tube construction and to thus reduce the pressure drop for the process fluids passing through the vessel.

I claim:

1. An apparatus for use in a vessel, having a shell and tube construction with refractory material protecting the tube sheet, to provide a flared entrance or exit for said tubes to reduce the pressure drop on the process fluid flowing through said vessel, comprising a form having a shank end and a flared end, said shank end being in the shape of a cylinder having a diameter less than the internal diameter of said tubes and a length of at least about 5 centimeters, and said flared end having a length at least equal to the thickness of said refractory and expanding conically outwardly at an angle of from about 15° to about 20°.

2. The apparatus of claim 1 wherein said form is constructed of wood, metal or plastic.

3. The apparatus of claim 2 further including a means for removal of said form after installation of said refractory material.

4. A method for reducing the pressure drop in a vessel having a shell enclosing a plurality of tubes which are retained by tube sheets wherein a refractory material is installed against said tube sheets comprising:

inserting a form in each of said plurality of tubes, said form having a shank end and a flared end, said shank end being in the shape of a cylinder having a diameter less than the internal diameter of said tubes but large enough to securely seat in each of said tubes and a length of at least about 5 centimeters, and said flared end having a length equal to or greater than the thickness of said refractory material and expanding conically outwardly at an angle of from about 15° to about 20°;

installing said refractory material to abut against said tube sheet and surrounding said forms; and removing said forms after solidification of said refractory material to provide a conically flared passageway through said refractory material as the inlet to said tubes to reduce the pressure drop created by the flow of process material through said vessel.

5. The method of claim 4 further including forming said conically flared passageway at both the entrance and exit of said tube.

* * * * *